United States Patent [19]

LaRosa et al.

[11] Patent Number: 4,930,922

[45] Date of Patent: Jun. 5, 1990

[54] COATING APPLICATOR WITH ROTATABLE FLOW CONTROL

[76] Inventors: Joseph P. LaRosa, 7 Cherokee Dr., Danbury, Conn. 06811; Gina Pisa, 665 Warren Ave., Thornwood, N.Y. 10594

[21] Appl. No.: 369,963

[22] Filed: Jun. 22, 1989

[51] Int. Cl.[5] ..... A45D 34/00

[52] U.S. Cl. ..... 401/281; 401/117; 401/186; 401/269; 401/277; 401/288

[58] Field of Search ..... 401/117, 186, 269, 277, 401/281, 288

[56] References Cited

U.S. PATENT DOCUMENTS

| | | | |
|---|---|---|---|
| 717,251 | 12/1902 | McMillian | 401/281 |
| 1,068,372 | 7/1913 | Thomas | 401/281 |
| 2,509,992 | 5/1950 | Soss | 401/281 |
| 2,702,396 | 2/1955 | Straszer | 401/281 |
| 2,887,708 | 5/1959 | Kane | 401/117 |

*Primary Examiner*—Steven A. Bratlie

*Attorney, Agent, or Firm*—Melvin H. Kurtz

[57] ABSTRACT

The invention is a liquid applicator having an integral brush means connected to a container for the liquid by a variable flow resistance liquid flow passage. The applicator has a movable sleeve which surrounds the brush and engages the cap to seal the brush in the environment of the liquid.

10 Claims, 3 Drawing Sheets

COATING APPLICATOR WITH ROTATABLE FLOW CONTROL

BACKGROUND OF THE INVENTION

Field of the Invention

The invention is a liquid applicator having an integral brush and container arrangement. The applicator is particularly useful for applying coatings such as nail polish, adhesives, paper correcting fluid, touch-up lacquer, touch-up enamel and the like which contain volatile materials.

Conventional coating applicator arrangements and particularly nail polish applicators, generally comprise a container for the nail polish and a container sealing cover which carries an applicator brush. The applicator brush is generally in contact with the coating material or at least in contact with the volatile vapors of the coating material. Contact with the coating material or the vapors of the volatile material prevents the coating material from drying on the brush and making the brush hard and unusable.

In applying the coating from the container the sealing cover with the brush is removed from the container and the coating applied to the surface. It is difficult to carry the proper quantity of coating to the surface. In addition, the open top of the container permits the volatile material to evaporate from the pool of coating material and the coating material becomes hard and unusable.

Recently pen-like applicators have been developed which comprise a reservoir for the coating material and an applicator arranged to contact the coating material in the reservoir through a valve arrangement. In most cases, the applicator is not a brush and the apparatus requires a low viscosity coating composition. One difficulty with this type of device is arranging the applicator so that it is in contact with fresh coating material or in contact with the volatile material of the coating composition, to prevent drying of the coating on the applicator, when the applicator is not in use.

An applicator is disclosed in Application U.S. Ser. No. 07/243,130 filed now U.S. Pat. No. 4,902,152. The applicator does not hve means for varying the resistance to liquid flow and therefore, provides no control of liquid flow to the applicator brush. The present invention is an improvement in the applicator of U.S. Ser. No. 07/243,130 now U.S. Pat. No. 4,902,152.

BRIEF SUMMARY OF THE INVENTION

In accordance with the present invention a liquid applicator having a brush integral with the container is provided. The applicator comprises a resiliently deformable container having an open neck, the container being adapted to hold a liquid, a closure support having at least one opening therethrough, means to sealingly engage the container neck and at least one thread engaging means on an outer surface; a brush holder, mounted on the closure support, carrying a brush with a passage for the liquid, the brush extending above the closure support, the brush holder having a conduit means for supplying liquid to the brush; a variable flow resistance liquid flow passage for controlling the liquid flow between the liquid in the container and the brush; sleeve means having cap engaging means disposed about the brush holder and displaceable between a first position where the brush is exposed for use and a second position wherein the sleeve means surrounds the brush; a cap means having thread means engagable with the thread engaging means on the closure support and means for engaging the cap engaging means on the sleeve means to move the sleeve means from the first position to the second position as the cap is rotated in engagement with the thread engaging means on the outside of the closure support, the cap means including sealing means which engage the sleeve means when the sleeve means is in the second position, to seal the brush in the environment of the inside of the container to prevent the brush from drying out.

DETAILED DESCRIPTION OF THE INVENTION

The liquid applicator of the invention will be described by reference to a preferred embodiment, however, other embodiments of the invention will be readily apparent to one skilled in the art.

Figure 1:
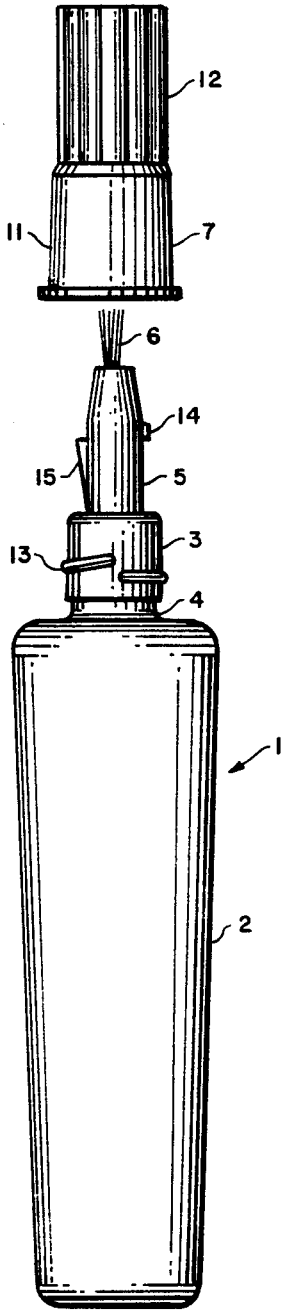
FIG. 1 is an elevational view of the device of the present invention with the cap removed.

As shown in FIG. 1 the applicator generally shown as 1 comprises a resiliently deformable container 2 for holding the liquid, a closure support 3 which sealingly engages neck 4 of container 2 and movably engages sleeve means 5 which is shown in a first position with the brush 6 exposed.

Figure 3:
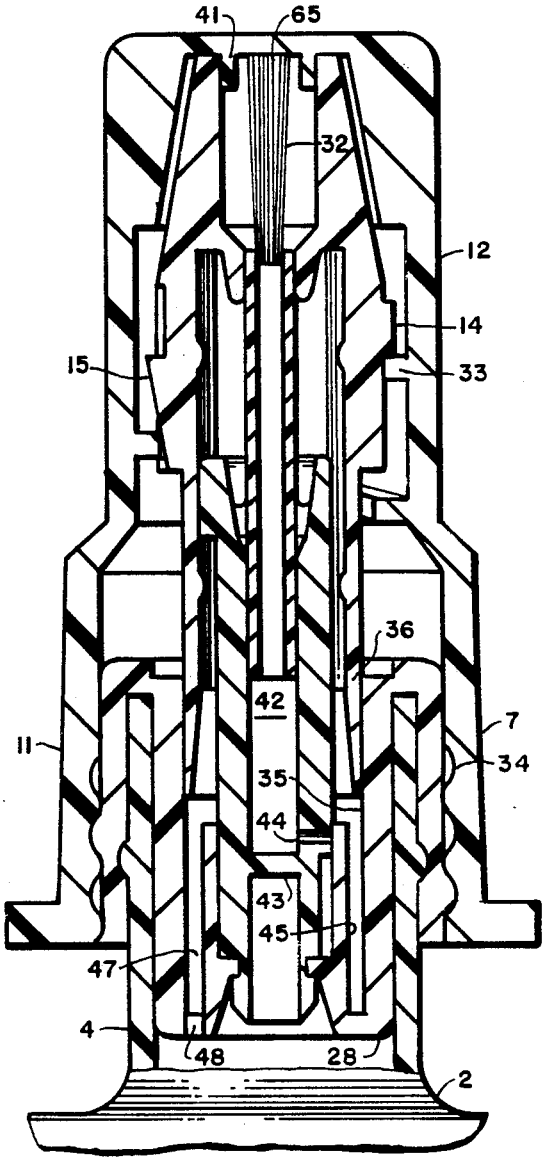
FIG. 3 is a sectional view of the bottle neck, closure support, brush holder, brush, sleeve and cap with the sleeve in the second position.

The closure support 3 carries thread engaging means 13 which engage first thread means 34 shown in FIG. 3 on the internal surface of cap means 7 in the section 11. It is preferred that the closure support carry thread engaging means 13 to provide a downward movement of the cap when the thread engaging means 13 engages the first thread means 34 in cap means 7. The downward movement of the cap gives the user the feel of cap closure. The thread means are preferred but is not essential to the applicator. Any type of engaging means can be provided as long as cap 7 and closure support 3 can be rotatably engaged.

Cap means 7 has a thread means in more narrow cap section 12 to engage cap engaging means 14 and 15 on sleeve means 5. The threads means in cap section 12 engage the cap engaging means 14 on sleeve means 5 and as cap 7 is rotated in a clockwise direction (arrow on FIG. 4) in engagement with threads 13, the sleeve means 5 is moved to a second position for sealingly engaging cap means 7.

Figure 2:
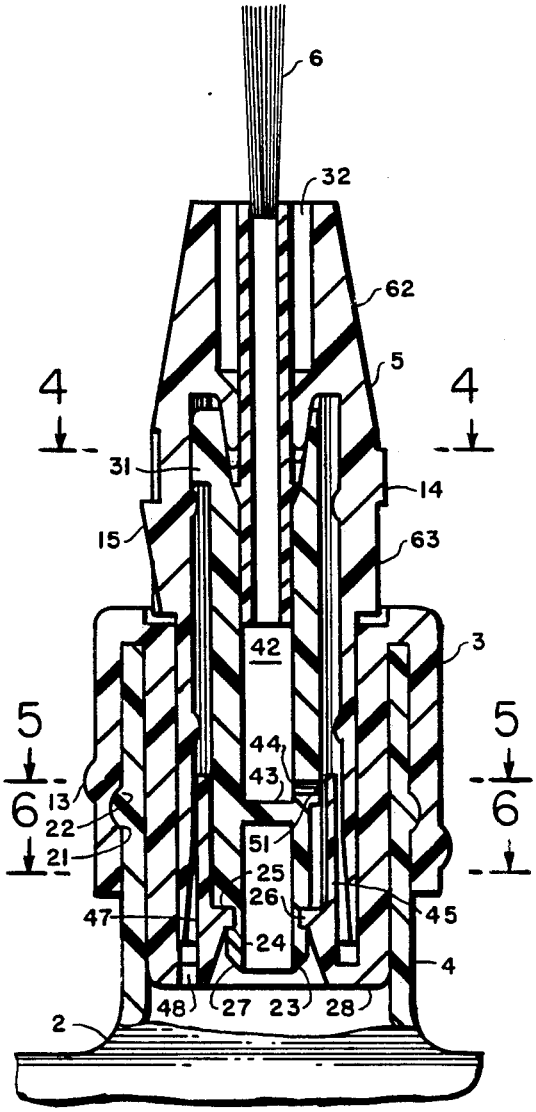
FIG. 2 is a sectional view of the bottle neck, closure support, brush holder brush and sleeve with the sleeve in the first position.

FIG. 2 shows a sectional view of the neck 4 portion of the liquid applicator of the invention with sleeve means 5 in the first position.

Closure support 3 is shown in sealing engagement with neck 4 of container 2. A notch 21 in closure support 3 engages a bead 22 on the neck 4 of container 2. The outside portion of neck 4 which engages closure support 3 can have ridges in the vertical direction or be knurled to prevent or retard rotation of closure support 3 when it is in rotatable engagement with cap means 7.

Brush holder 23 is rotatably mounted on closure support 3 by engagement of a notch 24 in brush holder 23 with a shoulder 25 of a circular hole 26 in closure support 3. The brush holder 23 is rotatably mounted on closure support 3 by forcing the end 27 of brush holder 23 through a circular hole smaller in diameter than brush holder 23, in the material, preferably plastic, of which closure support 3 is fabricated. Brush holder 23 is preferably fabricated from a resilient plastic mterial which aids in forming a rotatable snap-fit between the notched end of brush holder 23 and the hole 26 in closure support 3.

A brush 6 is mounted at the end 31 of brush holder 23 opposite the end with the notch. Generally, brush holder 23 has a hole in the end 31 into which brush 6 is inserted. Brush 6 has a hole through which the liquid flows to reach the bristles.

Brush holder 23 does not have a direct passage from end 27 to end 31 but relies upon a variable resistance tortuous flow path, which will be described later, to provide control of the rate of flow of the liquid from container 2 to brush 6.

A sleeve means 5 is disposed about brush holder 23. Sleeve means 5 is slideably mounted in closure support 3 so that when it is in a first position the brush 6 is exposed and available to apply liquid (FIG. 2) and when it is in a second position (FIG. 3) brush 6 is totally within a reservoir 32 at the end of sleeve means 5.

Sleeve means 5 sealingly and slideably engages inside walls 35 (FIG. 3) of closure support 3. The lower end skirt means 36 of sleeve means 5 bears against inside wall 35 of closure support 3 to provide a slideable sealing means to prevent loss of liquid and vapor from container 2.

Sleeve means 5 is moved from the first position to the second position by engagement of protuberance 14 with thread means 33 in the more narrow section 12 of cap 7. Cap 7 rotatably engages thread means 13 on closure support 3. Rotation of cap means 7 when in contact with closure support 3 causes engagement of thread means 34 in cap 7 with thread means 13 on closure support 3. Further rotation of cap 7 causes engagement of thread means 33 with protuberance 14 on sleeve means 5 and causes sleeve means 5 to rise out of the closure support 3. The sleeve means 5 continues to rise out of closure support 3 as cap 7 is rotated until the reservoir 32 is in sealing engagement with the cap 7.

Cap 7 on its top internal surface, has a depending element 41 which is a sealing ring which enters the interior of reservoir 32 closely adjacent its internal walls, to aid in sealing reservoir 32. When the reservoir is in sealing engagement with the cap, the reservoir and the brush are in communication with the vapors in the liquid container through blind hole 42 in brush holder 23 and the variable resistance liquid flow passage between brush 6 and container 2.

As used herein, variable resistance liquid flow passage denotes a passage through which the liquid in the container flows to the brush, which passage has means for varying the resistance to the flow of the liquid to provide the user with means to control the rate of liquid flowing to the brush. The variable resistance liquid flow passage comprises blind hole 42 which extends through the center of brush holder 23 to hole closing divider 43. Just above divider 43 a passage 44 in the side of brush holder 23 opens adjacent an interior wall 45 of closure support 3.

Figure 5:
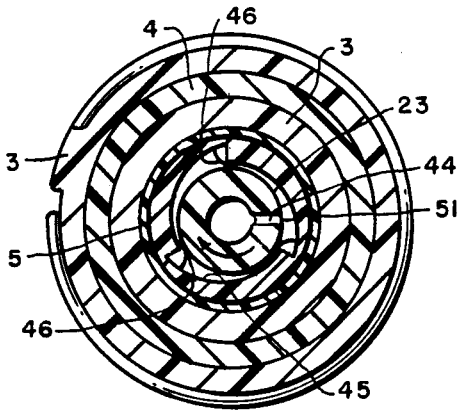
FIG. 5 is a plan sectional view taken along the line 5—5 of FIG. 2.

As shown in FIG. 5 wall 45 of closure support 3 varies in thickness around its circumference in three distinct positions. Brush holder 23 is rotatable in closure support 3 for about 120°. As brush holder 23 is rotated the clearance between the opening of hole 44 in brush holder 23 and the wall 45 of closure support 3 varies. The resistance to the flow of the liquid to the brush varies and enables the user of the liquid applicator to more easily control the rate of discharge of the liquid from the container to the brush.

Figure 6:
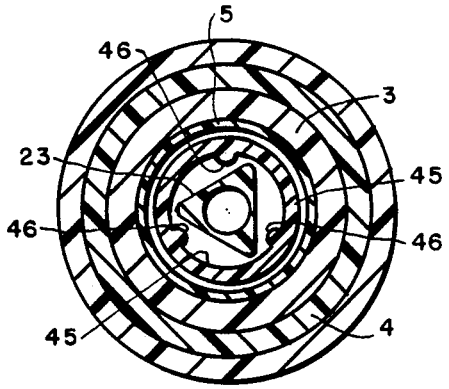
FIG. 6 is a plan sectional view taken along the 6—6 of FIG. 2.

Below the hole closing divider 43, the brush holder 23 has a triangular shape and wall 45 of closure support 3 carries three protuberances 46 (FIG. 6). The protuberances 46 are arranged at intervals of about 120° about the circumference. The protuberances correspond to the minimum thickness or maximum thickness portion of wall 45 at the point opposite opening 51 of passage 44. The protuberances 46 stop rotation of brush support 23 at a point of minimum or maximum clearance between the opening 51 of passage 44 and wall 45. When the cap is rotated in the direction of the arrow in FIG. 5 (right hand direction) to bring the sleeve means to the second position, as shown in FIG. 5, maximum clearance between the opening 51 of passage 44 and wall 45 is obtained if the variable thickness wall 45 has its minimum thickness (maximum clearance) at a point corresponding to the right side of the protuberance as seen in FIG. 5. It is desirable to provide the maximum clearance between the opening 51 of passage 44 and wall 45 when the applicator is closed (cap in place) so that there is maximum vapor flow between container 2 and brush 6.

The variable resistance liquid flow passage further comprises channel 47 and opening 48 in the base 28 of closure support 3 and the variable space between wall 45 and the opening 51 of passage 44. A plurality of openings 48 in closure support 3 can be present.

As shown in FIG. 5 when the liquid applicator is closed by means of right hand turning of the cap (direction of arrow), the variable resistance liquid flow passage will be in a position to provide a minimum of flow resistance (maximum clearance). However, when the cap is removed by a left hand (counterclockwise) turning, the variable resistance liquid flow passage will be in a position of maximum resistance (minimum clearance) which is desirable since it prevents the possibility of achieving undesired large liquid flow rates when the applicator 1 is first put into use. The liquid flow resistance can be adjusted to the desired degree of liquid flow resistance by rotation of sleeve means 5 after the cap 7 is removed.

In the figures, the rotation of the brush holder is shown as about one third ($\frac{1}{3}$) turn. However, the rotation can be about a full turn, half turn or any arbitrary fraction of a turn which can provide the amount of variation in liquid flow resistance required. As shown, the thickness of wall 45 varies over three cycles for ease of assembly of the brush holder and closure support. The brush holder can be inserted into the closure support without concern for the orientation of the brush support and closure support. The two pieces may be assembled in any orientation and achieve the required degree of variability in the liquid flow passage flow resistance.

As shown in FIG. 3 sleeve means 5 slideably engages brush holder 23 which combined with the sealingly slideable engagement of the skirt 36 of sleeve means 5 with the wall 35 of closure support 3 maintains the movement of sleeve means 5 linear.

Figure 4:
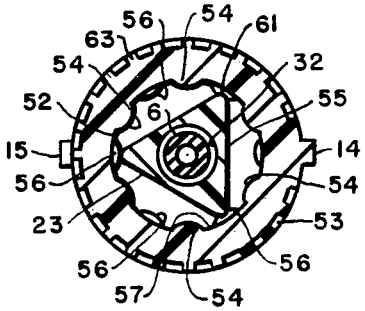
FIG. 4 is a plan sectional view taken along the line 4—4 of FIG. 2.

As shown in FIG. 4, the top of brush holder 23 comprises a triangularly shaped head 55 which carries the brush 6 and reservoir 32. The interior wall 57 of sleeve means 5 has vertical ribs 54 which engage the sides of vertices 61 of triangular shaped head 55. The vertices 61 are not sharp but rounded and slide against the ribs 54 and interior wall 57. Protuberances 56 are centered at the top and bottom of the area between the ridges 54 to limit the vertical travel of the sleeve means 5. The protuberances prevent the sleeve means 5 from being easily removed from engagement with triangular head 55 of brush holder 23.

The outer wall 53 of the straight portion 63 of head 62 of sleeve means 5 carries a series of indentation 53 which permit the user to easily grasp the head 62 and rotate the sleeve means 5 and brush holder 23 to vary the liquid flow passage resistance.

In operation, the cap 7 is removed by rotation in a counter clockwise manner (opposite to the direction of the arrow in FIG. 5). As the cap rotates, the threads 33 engage the top of cap engaging means 15 and the sleeve means 5 is urged into closure support 3. When the sleeve means 5 reaches the first position, the cap threads 33 disengage from cap engaging means 15 and cap thread means 34 disengage from cap thread engaging means 13. The cap is removed, the brush 6 exposed and the variable resistance liquid flow passage is in its position for providing maximum resistance to liquid flow. The user squeezes container 2 and the liquid to be applied is forced out through brush 6. If the liquid flow is too slow, the sleeve means 5 can be rotated in the direction of the arrow in FIG. 5 to reduce the resistance to liquid flow by increasing the clearance between outlet 51 of passage 44 in brush holder 23 and wall 45 of closure support 3.

The liquid can then be applied by contacting the surface with brush 6. Additional liquid can be supplied to brush 6 by squeezing container 2.

When use of brush 6 is completed, cap 7 is placed over closure support 3 and turned in the direction of the arrow in FIG. 5. As cap 7 is rotated, thread means 33 engage cap engaging protuberance 14 and causes sleeve means 5 to rise and engage sealing means 41 and the inner surface 65 of the top of cap 7. The seal between skirt 36 of sleeve means 5 and inner wall 35 of closure support 3 and the seal between the cap and sleeve means 5 permits brush 6 to be in the environment of the vapor or liquid in container 2 while preventing loss of volatile solvents from the liquid.

The tortuous liquid flow passage and variable liquid flow resistance of the liquid flow passage of the applicator of the present invention provides an applicator which can apply a more even liquid coating to a surface and is much easier to control than applicators known in the art.

We claim:

1. A liquid applicator which comprises a resiliently deformable container having an open neck, adapted to hold a liquid; a closure support having at least one opening therethrough, means to sealingly engage the container neck and at least one thread engaging means on an outer surface; a brush holder mounted on the closure support, carrying a brush with a passage for the liquid, the brush extending above the closure support, the brush holder having a conduit means for carrying liquid to the brush; a variable flow resistance liquid flow passage means, to aid in controlling the liquid flow between the liquid in the container and the brush; sleeve means between the container and the brush, having cap engaging means, disposed about the brush holder and displaceable between a first position where the brush is exposed for use and a second position where the sleeve means surrounds the brush; a cap means having thread means engageable with the thread engaging means on the closure support and means for engaging the cap engaging means on the sleeve means to move the sleeve means from the first position to the second position as the cap is rotated in engagement with the thread engaging means on the closure support, the cap means engages the sleeve means, when the sleeve means is in the second position, to seal the brush in the environment of the inside of the container to prevent the brush from drying out.

2. A liquid applicator of claim 1 wherein the variable resistance liquid flow passage means is in the position for lowest liquid flow resistance when the sleeve means is in the second position.

3. A liquid applicator of claim 1 wherein the cap engaging means on the sleeve means comprises a thread engaging protuberance and the means for engaging the cap engaging means comprises a thread means.

4. A liquid applicator of claim 1 wherein the variable flow resistance liquid flow passage comprises a tortuous passage.

5. A liquid applicator of claim 1 wherein the variable flow resistance liquid flow passage comprises a passage having two ends, an inlet end and an outlet end, and means to vary the distance between a passage end and a surface whereby the resistance to liquid flow is varied.

6. A liquid applicator of claim 4 wherein the variable flow resistance liquid flow passage comprises a passage having two ends an inlet end and an outlet end and means to vary the distance between a passage end and a surface whereby the resistance to liquid flow is varied.

7. A liquid applicator of claim 1 wherein the cap engaging means comprises at least one thread means.

8. A liquid applicator of claim 1 wherein the cap means comprises sealing means which engage the sleeve means when the sleeve means is in the second position to aid in sealing the brush in the environment of the inside of the container.

9. A liquid applicator of claim 2 wherein the variable flow resistance liquid flow passage comprises a tortuous passage.

10. A liquid applicator of claim 5 wherein the variable flow resistance liquid flow passage comprises a tortuous passage.

* * * * *